United States Patent [19]

Shrum

[11] 4,048,945

[45] Sept. 20, 1977

[54] REMOVABLE ANCHOR HAVING RETRIEVABLE BALLAST

[75] Inventor: Sidney J. Shrum, Charlotte, N.C.

[73] Assignee: Chevron Research Company, San Francisco, Calif.

[21] Appl. No.: 684,343

[22] Filed: May 7, 1976

[51] Int. Cl.[2] ..... B63B 21/24

[52] U.S. Cl. ..... 114/294; 61/98

[58] Field of Search ..... 114/230; 61/86–88, 61/90, 92, 94, 98, 99

[56] References Cited

U.S. PATENT DOCUMENTS

| | | | |
|---|---|---|---|
| 3,111,926 | 11/1963 | Shatto, Jr. | 114/206 R |
| 3,394,553 | 7/1968 | Vidal | 114/206 R |
| 3,431,879 | 3/1969 | Westling | 114/206 R |
| 3,780,685 | 12/1973 | Horton | 61/94 |
| 3,842,776 | 10/1974 | Wudtke | 114/206 R |

*Primary Examiner*—Trygve M. Blix
*Assistant Examiner*—Stuart M. Goldstein
*Attorney, Agent, or Firm*—R. T. Kloeppel; R. L. Freeland, Jr.

[57] ABSTRACT

Method and apparatus which provides a retrievable anchor for a floating vessel. The apparatus includes a ballast chain secured to a winch located on the vessel. The chain is lowered into a submergible anchor shell which together with the chain forms the anchor. A conduit can be provided for conveying to the shell a fluid for preventing corrosion and marine life growth on the chain.

The method includes connecting a ballast chain to an anchor shell and lowering it to the water bottom using the chain as a supporting link between the floating vessel and the shell. Once the shell is on the bottom, more ballast chain is placed into it so that the chain and the shell provide the necessary fixity for mooring the vessel. Subsequently, the upper end of the chain is connected to a pendant (a suspended rope secured to a locking means on the vessel) which may be used to lower the remaining portion of the chain. The chain and pendant can be tensioned so that, as they are respectively lowered through the water, they do not become entangled with nearby objects. A floating vessel is connected to the anchor shell by the pendant or an upper portion of the chain.

A conduit for moving a fluid to prevent marine growth and chain corrosion is connected at one end to a source of the fluid, while its other end is lowered into the anchor shell. Fluid flow is terminated when sufficent fluid is in the anchor shell. These steps are reversed when the anchor is to be retrieved and the floating vessel is to be relocated.

12 Claims, 7 Drawing Figures

REMOVABLE ANCHOR HAVING RETRIEVABLE BALLAST

BACKGROUND OF THE INVENTION

1. Field of the Invention

The invention relates to anchoring of floating vessels. More particularly, it relates to a retrievable anchor for a floating offshore structure used for drilling or producing hydroacarbons located beneath a body of water.

2. Prior Art

The following discussion of the prior art for illustrative purposes is centered on anchors used with tension leg platforms, Nevertheless, this invention is useful for other floating structures or vessels requiring anchors.

A tension leg platform is sufficiently buoyant so that while floating on the water surface it keeps cables, respectively connected to the platforms and a fixity at the subsea bottom, under tension. One way proposed to provide the fixity adjacent the subsea bottom is through the use of deadweight anchors. Such anchors may include an enclosure with a concrete covering of predetermined thickness and weight; the thickness is a function of the initial ballast required to lower the anchor member to the ocean bottom.

With the anchor on the subsea bottom, ballast material, which may be either a flowable granular material (such as taconite or granular hematite) or sea water, is added to it. But, there are problems associated with each. The problem with granular material is that it is irretrievable and must be wasted at the drilling site. In the case of sea water, the problem is getting a large enough container that is still retrievable to hold sufficient water to provide restraint or resistance to movement as in a sea anchor.

Another way to provide fixity for the cables is to use solid steel or concrete anchors. They, however, upon relocation are either abandoned or lifted up by costly winch equipment.

Needless to say, wasting ballast such as the granular material or a concrete anchor is costly. These costs are eliminated by utilizing the present invention summarized below because it is easily retrievable. Consequently, it is possible to write off the fabrication and installation cost over a period involving several subsequent uses rather than just one use.

Further, the use of the present invention with small boats such as rowboats and sailboats should not be overlooked. The reason is that retrival of it does not require great physical strength of the retriever (for example a person in the boat), since the chain is first raised to the boat and then the empty shell. Other advantages of the invention will become obvious from the Summary of the Invention, Description of the Preferred Embodiment, the Claims and the drawings.

SUMMARY OF THE INVENTION

This invention is used with floating vessels. The invention comprises a ballast chain that may be stored in chambers on the vessel during transit on sea. The chain is connected at one end to a securing means or first locking means like a winch with or without storage drums and maybe connected at the other end to an anchor shell by a second locking means as is conventionally known to those skilled in the art. Alternately, the chains stored on the vessel may pass over a wildcat: a drum or wheel on a windlass having in its circumference a deep groove with projections that engage the links of a chain cable as it passes and thus regulates the speed of the cable.

Sufficient chain may be lowered into the anchor shell to allow it to sink to the bottom. Once on the bottom, more chain is lowered into the shell — at least enough so that the shell and the ballast chain can be used to anchor the vessel. A pendant, used later to retrieve the chain, is then connected at one end to a locking means on the vessel and at its other end to the chain. The pendant can now be used to completely lower the chain into the anchor shell. When this is accomplished the pendant is then locked to the anchor shell and tensioned to avoid excessive motion of the vessel in sea currents and waves. The pendant performs as a connecting link between the floating vessel and the weighted anchor shell. On the other hand, if a pendant is not used, a portion of the chain may serve this function. In a so-called tension leg platform (TLP), this pendant may be an anchor line or a tension leg. In short, the combination of the shell with the ballast chain forms an anchor for a floating structure connected to it by the pendant or otherwise.

A corrosion and marine growth-preventing fluid that is biodegradable can be provided once the chain is in the submerged shell.

When the anchor is retrieved, the pendant is first disconnected from its clamp to the shell to relieve the pendant of tension between shell and vessel. The chain is then relocated into the vessel chambers aboard a floating vessel to lighten the anchor shell. The shell, which may have buoyant chambers, is then lifted to the vessel — preferably by the anchor chain connected to it.

The method of using a retrievable anchor chain is as follows. The anchor shell is lowered to the water bottom. If it is lowered by a drilling pipe, as may be the case with offshore drilling vessels, chain may be deposited into the shell to ballast it for lowering through the water. On the other hand, the shell may be lowered by the anchor chain connected to it. As before, sufficient chain may be deposited into the shell for lowering if the shell by itself is not sufficiently heavy. Or if buoyant chambers are located in the anchored shell, they are filled with sea water. In any of these cases, a pendant is attached at one end to the chain; and after the chain is lowered into the shell, the pendant is attached to the shell. The other end of the pendant is attached to a locking means secured to the platform and tensioned to avoid entanglement with nearby objects.

Then, an adjustable source of biodegradable fluid to prevent marine growth and corrosion of the chain may be connected to a conduit which is lowered into the anchor shell to fill it. This lowering procedure may include guiding and securing the conduit to the pendant.

The foregoing steps are reversed when the chain is retrieved. Additionally, a jetting system can be used to reduce suction occurring as the anchor shell is removed from the water bottom.

DESCRIPTION OF THE PREFERRED EMBODIMENT

Figure 1:
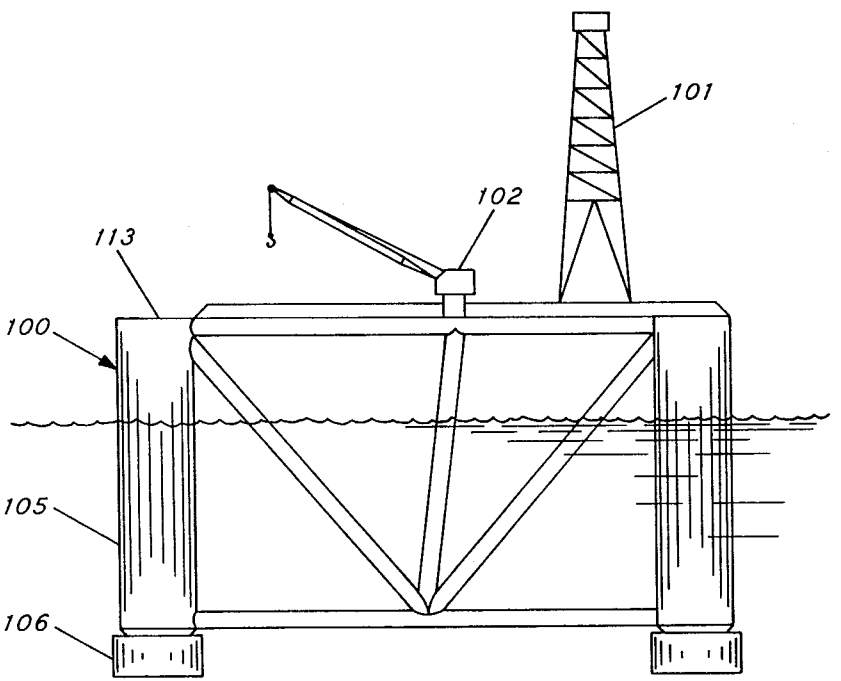
FIG. 1 is a schematic illustration of a tension leg platform located over a drilling site in a body of water.

FIG. 1 illustrates a tension leg platform (TLP) 100 having chain lockers or storage chambers 105 which can also be buoyant and, hence may also be referred to as buoyant member 105. The word "locker" is used to describe an enclosed chamber, generally located in the buoyant legs of a TLP, which aids in making the TLP positively buoyant. Since this function requires a large volume, it is understood that the buoyant legs will have excess capacity which may contain miscellaneous equipment. FIG. 1 also illustrates drilling equipment such as crane 102 and drilling derrick 101 located on working deck 113.

Figure 7:
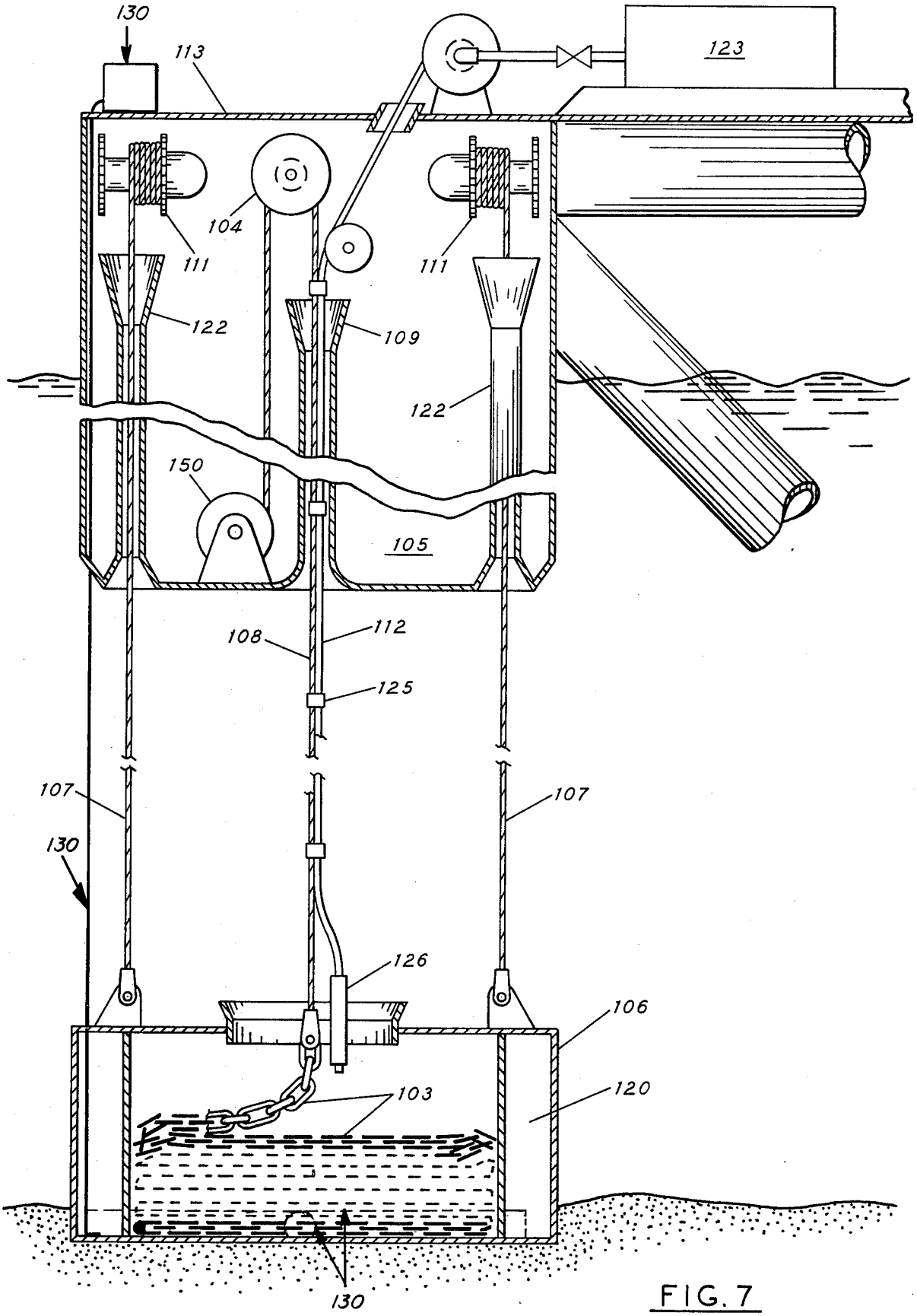
FIG. 7 schematically illustrates a cutaway longitudinal section of a buoyant chamber and an anchor shell used in FIGS. 1 to 6.

Within the chain locker or storage chambers 105 is a wildcat 104, FIG. 7. Also, stored in the locker is ballast chain 103 which has a density greater than water; for example, the chain may be made from cast iron or steel. It can be connected at one end to an anchor shell 106 (such as by a second locking means as is conventionally known by those skilled in the art) that has adjustably buoyant chambers 120, such that they can be filled with water and subsequently blown out to provide ballast or buoyancy to the shell as desired. In short, shell 106 is a means positionable on the subsea bottom for containing chain 103.

When the anchor shell 106 is lowered to the subsea bottom, it must be sufficiently ballasted to overcome any buoyancy it has. As suggested above, one way to overcome this is to fill the chambers with water. Alternatively, the shell could receive a predetermined amount of chain so as to provide sufficient ballast for the shell. Another possibility — although this is somewhat unnecessary in view of the other two more efficient ways of doing it — is to sufficiently weight the anchor shell with material like concrete so that the shell will sink to the subsea bottom under its own dead weight. Also, it may be desirable to sufficiently weight the shell to provide a temporary anchor for the floating structure connected to it.

Figure 2:
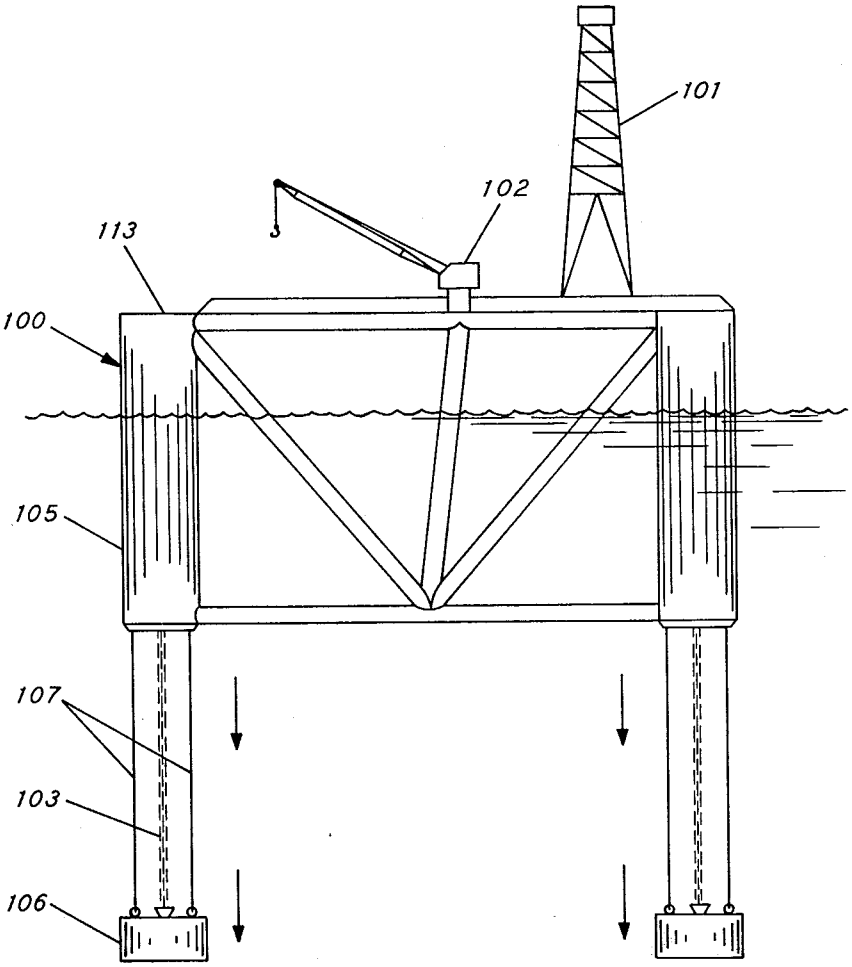
FIG. 2 illustrates the retrievable ballast chain connected to the anchor shell as it is being lowered to the ocean floor.

FIG. 2 illustrates the tension legs, cables 107. As mentioned before, these legs are secured to a fixity on the water bottom such as the present invention and are tensioned by the floating platform they are connected to. Their tension restrains the motion of the platform when horizontal or vertical forces are exerted against it.

As illustrated in FIG. 7, tension legs 107 can be stored on winches 111 located within chain locker 105. After they are connected to anchor shell 106, they are lowered through cables guides 122. At the same time wildcat 104 lowers chain 103 through guide 109 as the shell is lowered to the subsea bottom. To accumulate the necessary weight to provide a fixity for the tension cables, more chain is lowered into the shell. Aligning means, e.g. a horizontal moving alignment eye (not illustrated), within the shell may be provided to assure that the chain during its lowering operation will not get entangled with itself so as to thwart its retrieval.

Figure 4:
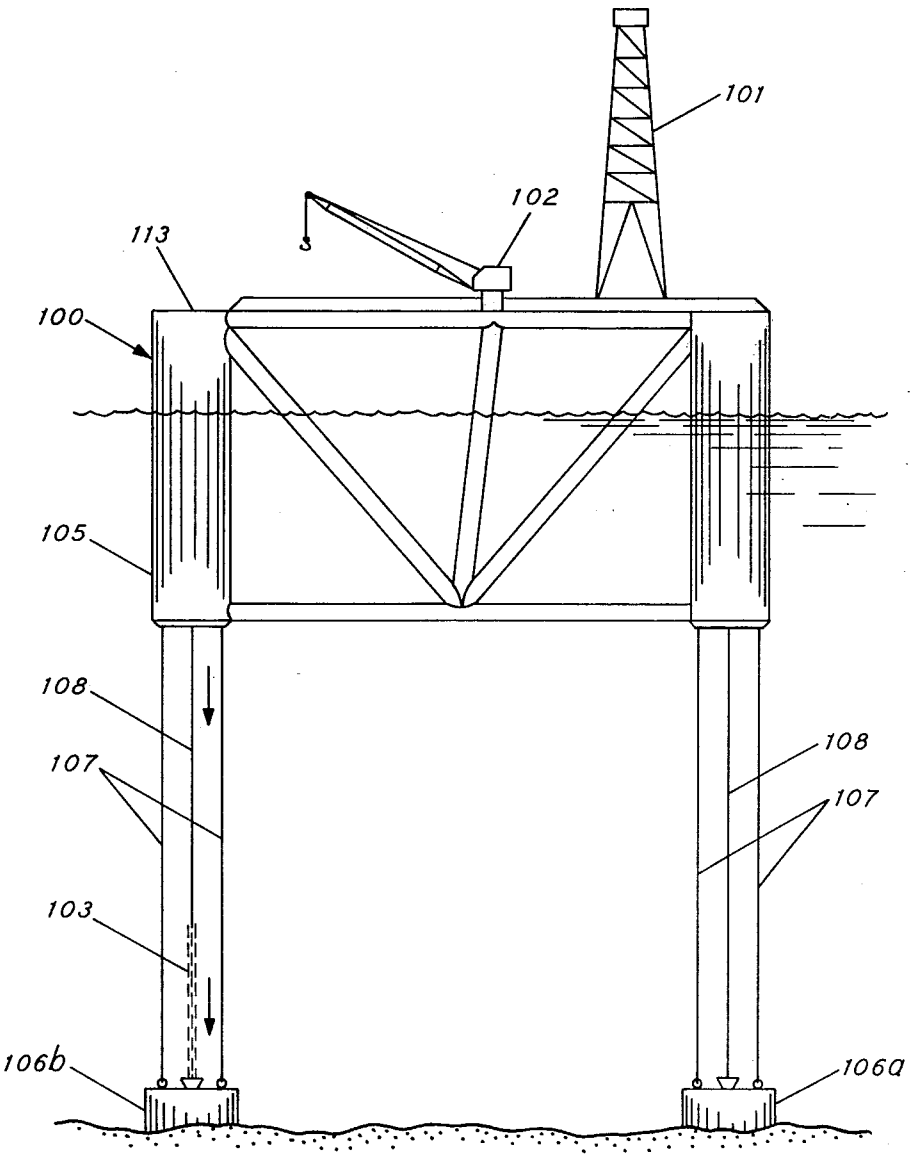
FIG. 4 shows the ballasting operation nearly complete. One end of the ballast chain is connected to a pendant, which is tensioned to prevent fouling or entanglement.
Figure 3:
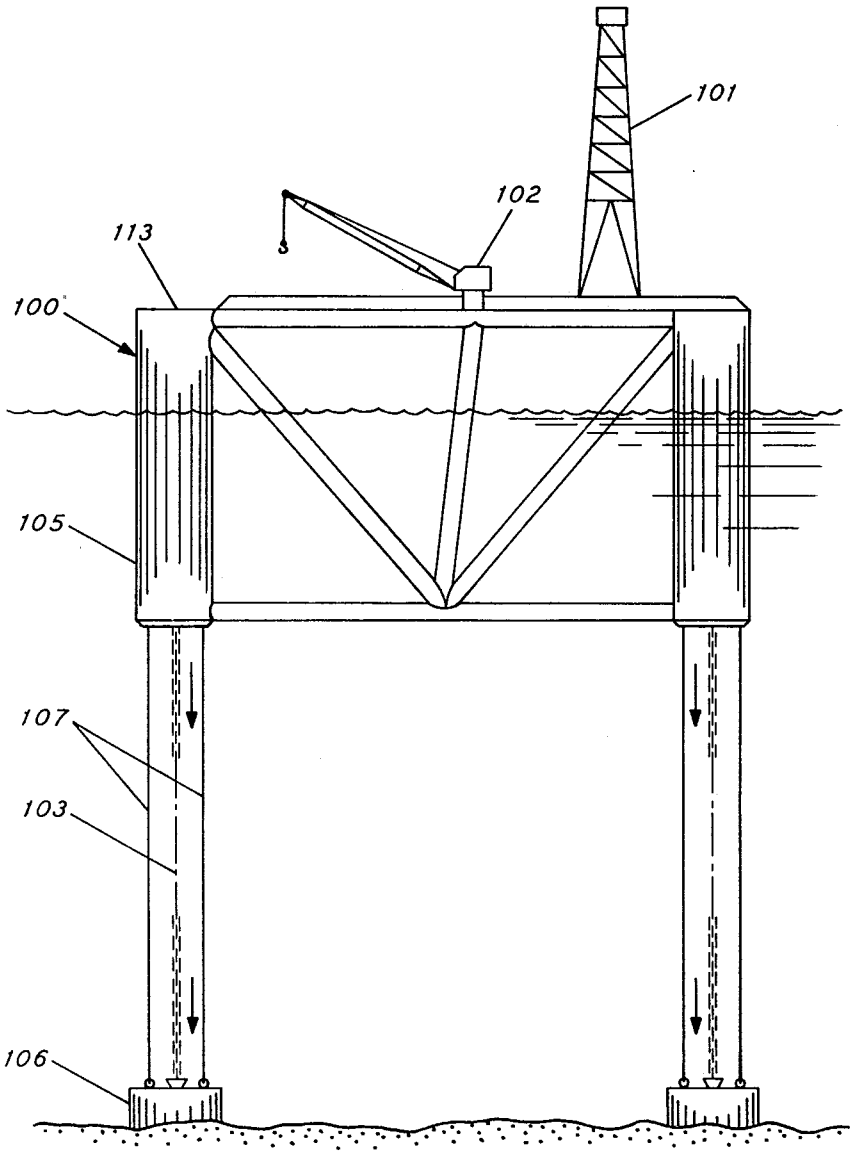
FIG. 3 illustrates the anchor shell located on the ocean floor while it is accumulating more ballast in the form of the chain.

FIG. 4 illustrates that the chain-lowering operation into each shell (or for that matter, chain-retrieval operation, FIGS. 5 and 6) does not have to be done simultaneously, as illustrated in FIG. 3. More specifically, in FIG. 4, the ballast chain on the right is completely lowered into the anchor shell 106*a* while the chain on the left is being lowered into shell 106*b.* It may be desirable to tension the chain during lowering so that it will not entangle with nearby objects.

After sufficient chain is lowered into the shell (FIG. 4), a pendant 108 is attached to the upper end of ballast chain 103 and secured to a locking means secured to the vessel or platform. If there is not enough ballast chain in the shell to adequately keep the chain tensioned, it may be desirable to secure the lower end of the pendant to the shell to facilitate subsequent tensioning of the pendant. This tensioning prevents fouling or entangling with either the cables 107 or other obstacles. The pendant's primary function is to provide a convenient way to lower and retrieve the ballast chain, see FIG. 5. It may also be used as anchor line and a guide for lowering conduit 112 described below.

Conduit 112 or other conveying means for fluid flow of a biodegradable fluid (heavier than water) that prevents marine growth on and corrosion of the chain may now be located into the shell. A source 123 of this fluid may be located on platform deck 113.

As illustrated in FIG. 7, rings 125 may be secured to flexible conduit 112 which has weighted or ballasted lower end or nozzle 126. These rings guide the conduit along the pendant 108 as the weighted end overcomes any buoyancy the conduit has. Consequently, the conduit enters shell 106 so that the fluid flowing under pressure from source 123 fills the shell while displacing any water in it. Another way to achieve this result is to prefill the shell 106 with the fluid before lowering it.

Figure 6:
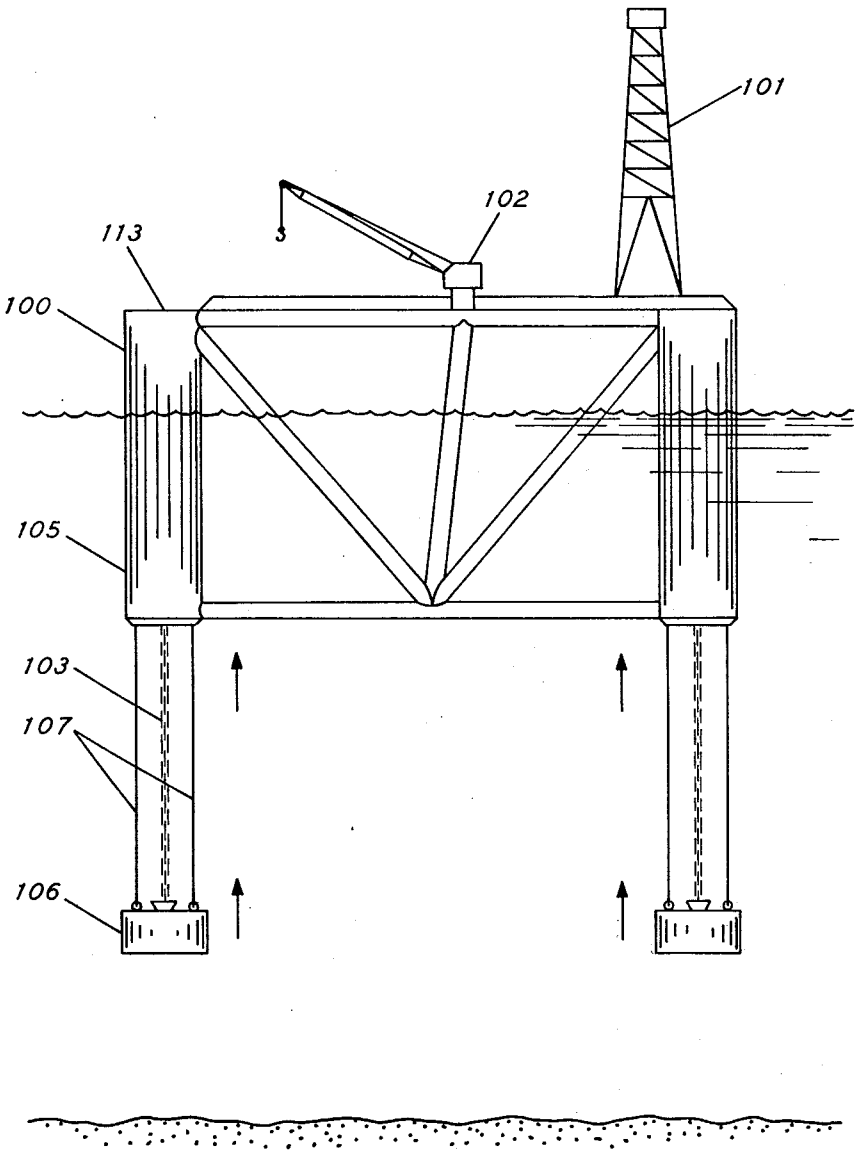
FIG. 6 schematically illustrates the anchor shell being raised by the ballast chain as the retrieval cycle is nearing completion.
Figure 5:
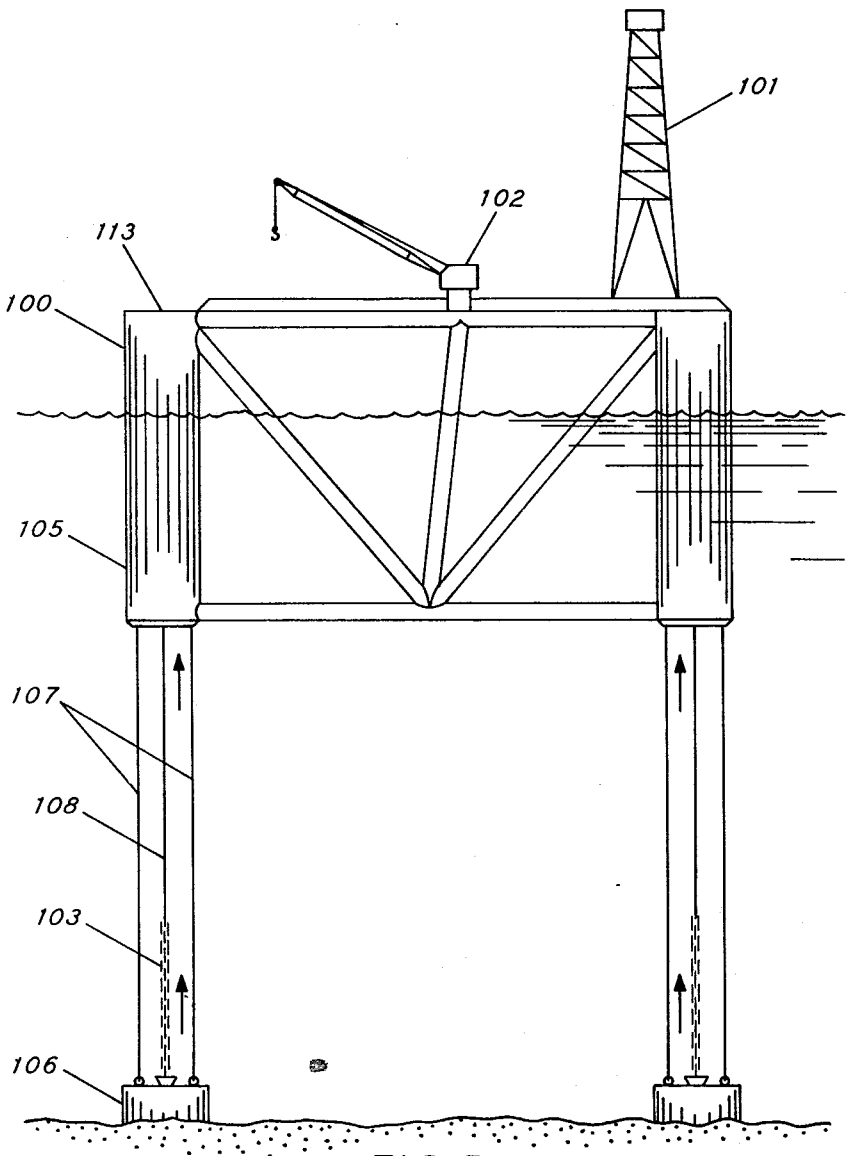
FIG. 5. schematically illustrates the beginning of the cycle to retrieve the chain.

When the tension leg platforms is to be relocated, the ballast chain 103 is moved upward, FIGS. 5 and 6, into respective lockers or storage chambers 105 by the use of winch 150, FIG. 7. When chain is removed from the shell 106, adjustably buoyant chambers 120 of the shell (FIG. 7) which had been filled with water to facilitate lowering it, are now blown out to give it further buoyancy. If the shell has settled into the subsea bottom, it may be necessary to use a jetting system 130 FIG. 7 — that can be built into the anchor shell — to break off any suction resulting from the settlement. Such a jetting system is well within the skill of one experienced in the art of jetting. The lightened shell 106 is now ready for relocation to lockers 105. While the shell is being raised, the pendant 108 and conduit 112 are winched up, along with the tension legs 107. Upon completion, the platform is ready for relocation. As mentioned before, these operations may or may not be done simultaneously for each anchor shell.

In summary, the anchor shell with ballast chain in it forms the anchor for a floating vessel attached to it through the pendant or otherwise.

The terms and expressions used in the preceding are terms of description and not of limitation; there is no intention in the use of the terms and expressions to exclude any equivalents of the features shown and described which are feasible within the scope of the following claims.

What is claimed is:

1. A removable anchor for a floating vessel, comprising:

a retrievable ballast chain having a density greater than water, said retrievable ballast chain lowerable from said floating vessel;

means secured to said vessel floating on a body of water for lowering and raising said ballast chain; and retrievable enclosure means positionable on the bottom of said body of water, for containing said ballast chain lowered into said retrievable enclosure means, so that the combined weight of said ballast chain and said retrievable enclosure means form a fixity for anchoring said vessel.

2. A retrievable anchor for a floating vessel, comprising:

a ballast chain having a density greater than water;

means secured to said vessel floating on a body of water for lowering and raising said chain;

enclosure means positionable on the subsea bottom for containing said chain lowered into said enclosure means, so that the combined weight of said ballast chain and said enclosure means form a fixity for anchoring said vessel;

first locking means secured to said vessel and second locking means secured to said enclosure means, said first and second locking means used to secure said chain so that a portion of said chan is a link between said enclosure means and said vessel.

3. A retrievable anchor for a floating vessel, comprising:

a ballast chain having a density greater than water;

means secured to said vessel floating on a body of water for lowering and raising said chain;

enclosure means positionable on the sea bottom for containing said chain lowered into said enclosure means, so that the combined weight of said ballast chain and said enclosure means form a fixity for anchoring said vessel;

first locking means secured to said vessel and second locking means secured to said enclosure means; and a pendant attached between said first and said second locking means, said pendant used to retrieve said chain so as to lighten said enclosure means prior to retrieving said enclosure means from the sea bottom.

4. The retrievable anchor for a floating vessel comprising:

a ballast chain having a density greater than water;

means secured to said vessel floating on a body of water for lowering and raising said chain;

enclosure means positionable on the water bottom for containing said chain lowered into said enclosure means, so that said chain and said enclosure means form a fixity for anchoring said vessel connected to said enclosure means;

a source of fluid for preventing corrosion and marine life formation on said chain; and conveying means for fluid flow from said source of fluid to said enclosure means, said conveying means for fluid flow connected to said source of fluid and locatable in said enclosure means.

5. A retrievable anchor for a tension leg platform in a body of water having tensioned cables secured to said anchor, comprising:

said platform having buoyancy chambers secured to said platform;

a wildcat secured within said buoyancy chambers;

a chain having two ends and a density greater than water, said chain passing over said wildcat for subsequent lowering, an enclosure having adjustably buoyant chambers;

one end of said chain connected to said buoyancy chambers, the other end of said chain connected to said enclosure, so that said chain after passing over said wildcat fills said enclosure as ballast;

a pendant used to remove said chain from said enclosure when desired;

first locking means secured to said platform, said pendant attached at one end to said chain, the other end of said pendant attached to said first locking means; and second locking means secured to said enclosure so that the lower end of said pendant is connectable to said second locking means.

6. The retrievable anchor for a tension leg platform of claim 5, including:

a source of biodegradable fluid heavier than water for preventing corrosion and marine life formation on said chain;

conveying means for permitting fluid to flow from said source to said enclosure, said conveying means connected to said source and insertable into said enclosure so that the enclosure can be filled with said fluid; and means in said enclosure for breaking the suction from the floor of said body of water.

7. A method of lowering a removable anchor for a marine vessel, comprising the steps of:

lowering a retrievable enclosure means to the bottom of a body of water and aligning a reusable, retrievable ballast chain in said retrievable enclosure means to obtain sufficient ballast in said retrievable enclosure means to provide a fixity to moor said vessel.

8. A method of lowering a retrievable anchor for a marine vessel, comprising the steps of:

lowering an enclosure means to the bottom of a body of water and aligning ballast chain in the enclosure means to obtain sufficient ballast in said enclosure means to provide a fixity to moor said vessel;

tensioning said ballast chain to avoid entanglement with nearby objects while lowering said chain into said enclosure means;

connecting said chain to a pendant when sufficient ballast in said enclosure means is obtained to provide a fixity to moor said vessel;

securing said pendant to said enclosure means;

connecting the pendant to a locking means secured to said vessel; and tensioning said pendant to avoid entanglement with nearby objects.

9. A method of lowering a retrievable anchor for a marine vessel comprising the steps of:

lowering an enclosure means to the bottom of a body of water and aligning ballast chain in said enclosure means to obtain sufficient ballast in said enclosure means to provide a fixity to moor said vessel;

connecting a conduit to a source of fluid for preventing marine growth and corrosion of said chain;

lowering said conduit into said enclosure means;

allowing the fluid to flow into the enclosure means through said conduit; and terminating fluid flow through said conduit when the desired amount of fluid is in said enclosure means.

10. The method of lowering a retrievable anchor, from a vessel comprising the steps of:

lowering a ballast chain connected to an anchor shell into the anchor shell to obtain sufficient ballast in order to overcome the shell's buoyancy for subsequent shell lowering;

connecting said ballast chain to a pendant;

connecting the upper end of said pendant to a locking means secured to said vessel;

locking the lower end of said pendant to said shell;

tensioning said chain to avoid entanglement with nearby objects;

connecting a conduit to a source of fluid for preventing marine growth and corrosion;

lowering said conduit into said anchor shell;

allowing the fluid to flow through said conduit into the anchor shell; and terminating fluid flow when the desired amount of fluid is in said anchor shell.

11. A method of raising a retrievable anchor of the type having an anchor shell containing sufficient ballast chain to provide ballast to said shell to function as an anchor, said ballast chain connected to said shell and a pendant, said pendant being connected to a locking means on a floating vessel and said shell, comprising the steps of:

raising said pendant so that said pendant, said ballast chain and said shell are raised to said vessel;

storing said ballast chain when said ballast chain is raised to said vessel; and storing said anchor shell when said shell is raised by said pendant and said ballast chain to said vessel.

12. A method of raising a retrievable anchor connected to a floating vessel, said anchor having an anchor shell located on the sea bottom, said shell containing sufficient ballast chain with a density greater than water to provide sufficient ballast to said shell to function as an anchor, said shell having a conveying means for fluid flow of a biodegradable fluid that prevents marine growth and corrosion to said ballast chain, comprising the steps of:

raising to said floating vessel said conveying means;

storing said conveying means in said vessel;

raising to said vessel a pendant connected to said ballast chain, said ballast chain being connected to said anchor shell so that said ballast chain and anchor shell are raised to said vessel; and storing said pendant, ballast chain and shell on said vessel.

* * * * *